United States Patent [19]

Probst et al.

[11] Patent Number: 4,995,760

[45] **Date of Patent: * Feb. 26, 1991**

[54] SCRAPING DEVICE FOR MAKING A SUBGRADE

[76] Inventors: Martin Probst, Riedstrasse 37, 7141 Steinheim; Herbert Schaffarzyk, Ellernstrasse 62; Walter Schaffarzyk, Herman Allmersweg 13, both of 2870 Delmenhorst, all of Fed. Rep. of Germany

[ * ] Notice: The portion of the term of this patent subsequent to Jan. 23, 2007 has been disclaimed.

[21] Appl. No.: 453,730

[22] Filed: Dec. 20, 1989

Related U.S. Application Data

[63] Continuation of Ser. No. 167,270, Mar. 11, 1988, Pat. No. 4,895,477.

[30] Foreign Application Priority Data

Mar. 13, 1987 [DE] Fed. Rep. of Germany ..... 3708249

[51] Int. Cl.[5] ..... E01C 19/22

[52] U.S. Cl. ..... 404/119; 404/118; 37/117.5

[58] Field of Search ..... 404/118, 119, 120; 37/108 R, 108 A, 117.5, 274, 281, DIG. 3, DIG. 12; 172/701.1, 780, 445.1

[56] References Cited

U.S. PATENT DOCUMENTS

| | | | |
|---|---|---|---|
| 3,901,618 | 8/1975 | Sant'Agata | 404/118 |
| 4,009,529 | 3/1977 | Johnson | 37/117.5 |
| 4,208,814 | 6/1980 | Stone | 37/117.5 |
| 4,395,156 | 7/1983 | Sprague, III | 404/118 X |
| 4,545,721 | 10/1985 | Pettersson | 414/724 |
| 4,572,301 | 2/1986 | Bourgeois, Jr. | 172/445.1 |
| 4,630,964 | 12/1986 | Allen | 404/119 X |

*Primary Examiner*—Ramon S. Britts
*Assistant Examiner*—Gay Ann Spahn
*Attorney, Agent, or Firm*—Anthony A. O'Brien

[57] ABSTRACT

Scraping device for removing excess subgrade material from the surface of a subgrade to level the subgrade, which includes a lower wall, side walls, a rear wall and an optional top wall defining a container for collecting removed excess subgrade material, and attachment means so the device may be lifted and transported by a fork lift truck or the bucket of an earth moving vehicle for emptying; advantageously the apparatus is formed in sections which can be disassembled and stacked one within another.

4 Claims, 1 Drawing Sheet

SCRAPING DEVICE FOR MAKING A SUBGRADE

This application is a continuation of application Ser. No. 07/167,270, filed Mar. 11, 1988.

The device relates to a scraping device for making a subgrade and wherein a bar-shaped scraping blade is known which exhibits on its sides rollers that are set on the supporting bars that define the subgrade. The scraping blade is then pulled by a construction vehicle and the rollers run on the supporting bars that are laid parallel to one another. The scraping blade is configured so that it "peels off" the excess sand. This sand accumulates to a limited extent during the operation in a curvature of the scraping blade. But it is not held permanently in this curvature. A drawback consists in that the sand collected in the cavity must be continuously removed from the cavity of the scraping blade with the help of a shovel. For example, the sand that is removed is transferred into the wheel loader shovel of the construction vehicle pulling the scraping blade.

The object of the present invention is to configure the scraping device of the above-mentioned type so that a complicated and thus time-consuming and expensive sand removal can be avoided during the scraping process.

An essential advantage of the scraping device according to the invention consists in the fact that, instead of the known cavity, it exhibits a bucket-shaped receptacle in which the sand that is stripped off during a scraping process can be held so that during the scraping process a manual sand removal is not necessary.

Figure 2A:
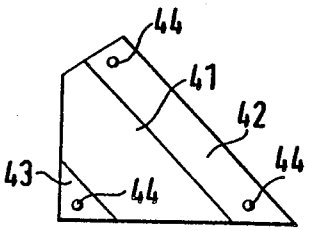

An advantage of an advantageous configuration of the scraping device according to the invention is that it can be assembled from several segments (two edge segments and several middle segments) so that the working width can be varied in any way. Especially preferred is the scraping device made of segments that can be assembled which consists of two edge segments and a middle segment. A further advantage of the scraping device that can be assembled from individual segments consists in that it can be disassembled to achieve a limited space requirement during transport, shipping and storage. In this case, the individual segments can be advantageously stacked in one another because of their configuration. FIG. 2A is a side elevational view of one of the walls in FIG. 2; for example, up to six segments can be stacked in one another.

An advantage of a further especially preferred configuration of the invention consists in the fact that a general-purpose receiving device with insertion pockets for palette forks is provided. This makes it possible for the scraping device made of one piece or assembled from several segments to be attached in an extremely simple and rapid way, by inserting the palette forks of a construction vehicle into the insertion pockets, to the construction vehicle and to be transported by the latter, for example for setting down on the supporting bars or for sand delivery.

In a further preferred configuration, in addition to the general-purpose receiving device with the insertion pockets described or instead of these receiving devices, receiving or attachment devices are provided that make possible a holding of the present scraping device with the normal shovel of a wheel loader.

Further preferred configurations of the present scraping device relates to the vertical adjustment by adjustment devices provided on the respective outer walls of the edge segments.

Figure 3:
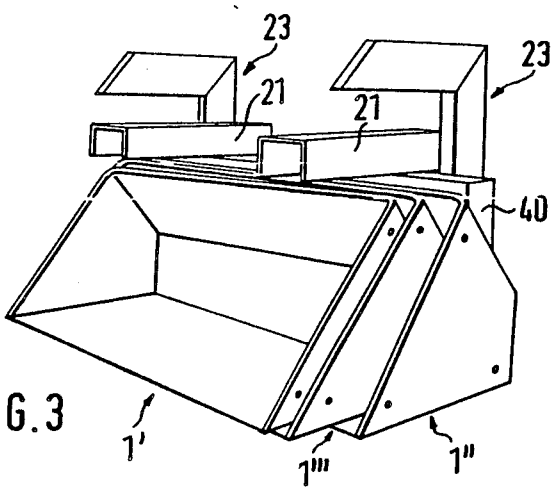
Figure 1:
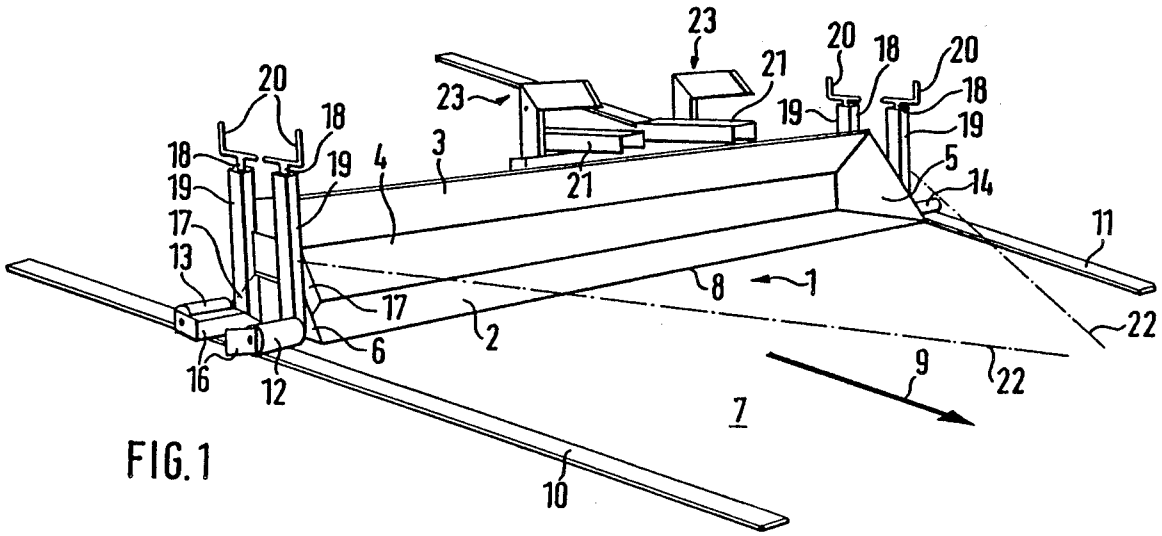
Figure 2:
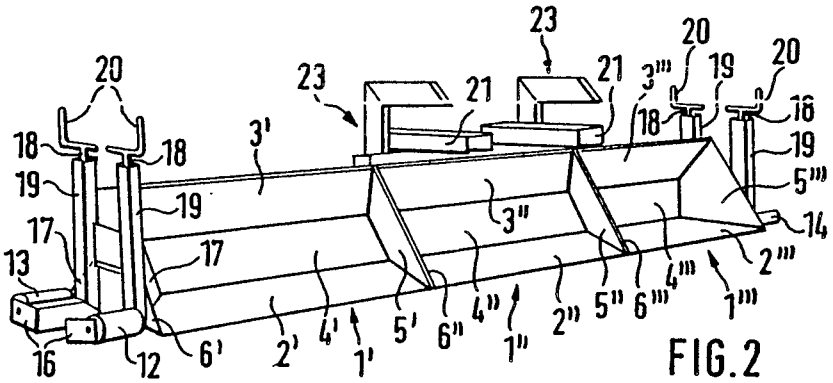

The invention and its configurations are described below in more detail in connection with the drawings. There are shown in:

FIG. 1, a first, one-piece configuration of the scraping device according to the invention;

FIG. 2, a second configuration of the scraping bar according to the invention assembled from three segments;

FIG. 2A, an end view of the right side wall;

FIG. 3, segments stacked in one another of a disassembled scraping device according to FIG. 2.

In the way that can be seen in FIG. 1, present scraping device 1 essentially exhibits a bucket-shaped part that consists of a lower wall 2, a rear wall 4, side walls 5, 6 and preferably an upper wall 3. Here said walls 2 to 6 are fastened to one another so that they enclose a space that opens toward the unworked subgrade or subcrust 7. The sand that accumulates during the operation and that is stripped off from the subgrade by front edge 8 of lower wall 2 is held in the space enclosed by walls 2 to 6. During the operation the scraping device is pulled in the direction indicated by arrow 9 by suitable propelling equipment. The space enclosed by the bucket-shaped part preferably has a carrying capacity of 0.3–1 $m^3$.

On each of side walls 5 and 6 there are provided sliding devices with which scraping device 1 is set on supporting bars 10, 11, shown diagrammatically in FIG. 1, which are laid parallel to one another in the subcrust. The height of these supporting bars defines the height of the subgrade to be made. Preferably, the sliding devices each consist of rollers at a distance from one another. For example, on side wall 6, in the way shown, rollers 12 and 13 are rotatably mounted at a distance from one another in suitable holding devices 16, while on side wall 5 rollers 14 are mounted in a similar way, of which only one roller can be seen in FIG. 1. Rollers 12, 13, and 14 can each be attached to side walls 6 or 5 so that between the plane of the upper sides of supporting bars 10 and 11 and the lower surface of lower wall 2 an acute angle exists or so that said surface and said plane run parallel to one another.

Instead of the rollers described, in a way known in the art there can also be provided, as sliding surfaces, on the outer surfaces of side walls 5, 6 angular elements whose first legs are attached to be vertically adjustable on the outer surfaces and whose other legs, which extend perpendicular to the first legs, are supported on the lateral raised verges adjacent to the subgrade and are pulled over these raised verges.

Preferably, walls 2 to 6 for the formation of said bucket shape are welded to one another. The space enclosed by walls 2 to 6 is so large that the sand that accumulates during an operation in which scraping device 1 is pulled in direction 9 over the subcrust 7 can be held in it.

With present scraping device 1 work is done so that on the surface to be worked basically somewhat more sand or gravel material is applied than is actually needed. During the entire operation material is thus stripped off by edge 8 of lower wall 2 and held in the space enclosed by walls 2 to 6.

In the way seen in FIG. 1, sliding devices or rollers 12 to 14 and their corresponding holding devices 16 can each be attached to elements 17 in which the one threaded end of a spindle 18 is rotatably mounted in a fixed spindle nut. Here spindles 18 extend in a vertical direction when rollers 12 to 14 are set on supporting bars 10, 11. Above each element 17 a further element 19 each is placed which is fastened, preferably screwed, onto corresponding side wall 6 or 5. Each element 19 exhibits a borehole through which corresponding spindle 18 is guided and fixed in an axial direction. The opposite free end of spindle 18 in element 17 projects beyond corresponding further element 19 and is provided with a crank 20. Therefore by turning cranks 20 the height of the scraping device or the height of edge 8 of lower wall 2 can be adjusted relative to the surface of supporting bars 10 and 11. In addition, by turning cranks 20, optionally also the acute angle between the plane of the upper side of supporting bars 10; 11 or raised verges and the surface of lower wall 2 can be adjusted.

On scraping device 1 there are attached, in the way seen in FIG. 1, preferably about equidistant from the middle of the longitudinal extension of scraping device 1, two receiving pockets 21 which exhibit the form of rectangular tubes and which extend perpendicular to the longitudinal axis of scraping device 1. In these receiving devices the palette forks of propelling equipment or of a wheel loader (not shown) can be inserted. This scraping device can then be transported by the wheel loader, for example to set it on supporting bars 10 and 11 or to lift this device 1 during the operation, remove it from its existing position and to empty the sand or gravel in it at another place. After it is emptied, this scraping device can then be set again on supporting bars 10 and 11. After retracting the palette forks from receiving pockets 21 (driving the wheel loader in the direction of arrow 9), this scraping device, which is connected to the wheel loader by chains or wire cables 22, shown diagrammatically, is pulled further over supporting bars 10 and 11 by driving the wheel loader in the direction of arrow 9.

Preferably, receiving pockets 21 are attached in a suitable way to scraping device 1. For example, they are attached to a plate 40, suitably welded, which is attached to rear wall 4 of the scraping bar, preferably welded.

To be able to move scraping device 1 also by using a shovel of propelling equipment or a wheel loaded, in addition to receiving pockets 21 already mentioned, angular parts 23 are preferably attached to scraping device 1 on said plate 40 in such a way, preferably welded, that their first legs extend perpendicular to the longitudinal axis of scraping device 1 and that they are approximately equidistant from the middle of the longitudinal extension of scraping device 1. The other legs of angular parts 23 are attached or welded in a suitable way to scraping device 1, for example on said plate 40. To lift and move scraping device 1 the shovel of a wheel loader can be brought to rest against the edges of the first legs of angular parts 23, 23 that face subcrust 7 and the shovel bottom engages in the space that is preferably formed between the upper sides of receiving pockets 21 and the lower edges of the first legs so that the required moment of tilt can be applied to manipulate the scraping bar.

Emptying of the scraping device can occur preferably from the propelling equipment by the control hydraulics provided there for a normal shovel so that no additional expense and no additional handles are necessary.

A further development of the invention is explained below in more detail in connection with FIGS. 2 and 3. Details of FIGS. 2 and 3, which were already explained in connection with FIG. 1, are designated in the corresponding way. The difference between the embodiment of FIG. 2 and 3 and the embodiment of FIG. 1 lies in the fact that the embodiment in FIG. 2 and 3 is assembled from several segments 1', 1'', 1'''. For example, the scraping device of FIG. 2 consists of three segments, specifically of two edge segments 1', 1''' and a middle segment 1''. But to construct the scraping device and to adapt it to a desired working width, two or more than three segments can be connected to one another. Each segment 1' or 1'' or 1''' exhibits a lower wall 2', 2'', 2'''and preferably an upper wall 3', 3'', 3''', and after assembling segments 1', 1'' and 1''' lower walls 2', 2'' and 2''' are in a plane or each segment represents an extension of the respective adjacent lower walls. The same also applies optionally to upper walls 3', 3'', 3'''. To middle segment 1'' there are attached, in the way described already in connection with FIG. 1, receiving pockets 21 and/or angular parts 23. Holding devices 16, rollers 12, 13, 14, elements 17, further elements 19, spindles 18 and handles 20 or the described angular elements are attached detachably on the outer surface of outer side wall 5''' or 6' of edge segments 1''' or 1'. The attachment of edge segments 1' and 1''' to middle segment 1'' occurs in that side walls 5' and 6'' facing one another and side walls 5'' and 6' facing one another are screwed to one another detachably in a suitable way. In this case, these walls that face one another and are attached to one another are preferably configured so that they make possible passage of sand or gravel in the longitudinal direction of the scraping device. According to FIG. 2*a* the said walls are preferably configured so that there is a passage 41 between one of the openings of the space of the scraping device or front wall part 42 forming the segments and a rear wall corner part 43 that is attached to rear wall 4', 4'', 4''' and bottom wall 2', 2'', 2'''. By these passages 41, in an advantageous way a distribution or shifting of sand or gravel in the longitudinal direction of the scraping device can occur during a scraping operation. In FIG. 2*a* the clamping bolts that run through front wall parts 42 and rear wall corner parts 43 are designated by 44.

It is also possible to configure middle segment 1'', in the direction of insertion pockets 21, 21 or relative to the first legs of angular parts 23, higher than edge segments 1' and 1''', so that the larger sand or gravel portion that accumulates in the middle of the subgrade can be held.

Rollers 12, 13, 14, holding devices 16, elements 17, further elements 19 etc. can be attached detachably to corresponding side walls 6' or 5''' of edge segments 1' and 1'''. In this case segments 1', 1'' and 1''' can be configured and dimensioned so that in the disassembled state of the scraping device they can be inserted into one another and stacked to save space. More precisely, in this case lower walls 2', 2'', 2''' and upper walls 3', 3'', 3''' of respective segments 1', 1'' and 1''' run slanted relative to one another and have individual segments 1', 1'' and 1''' of differing lengths so that they can be placed into one another "like paper bags."

FIG. 3 shows the state in which, in intermediate segment 1'', which exhibits the longest longitudinal extension, edge segments 1' and 1''', whose lengths are smaller than the length of intermediate segment 1'' and which exhibit differing lengths, are inserted.

We claim:

1. Scraping device adapted to be towable over a subgrade to remove excess subgrade material from the surface thereof, said device comprising a rectangular lower wall (2) defining a scraping bar for removing excess subgrade material, a rectangular top wall (3), a rectangular rear wall (4) upstanding from said lower wall (2) and extending between said top and lower walls (2,3), opposed side walls (5,6) respectively disposed at opposite ends of said lower, top and end walls (2,3 and 4) and being fastened together to define a bucket-shaped container for collecting removed excess subgrade material, fastening means (17) attached to outside surfaces of said side walls (5,6), holding devices (16) secured to each of said fastening means (17), rollers (12,13) attached to said holding devices (16), adjustment means (18,19,20) for adjusting said rollers (12,13), said rollers (12,13) adapted to be rotatably disposed on a bar (10,11) whereby the bucket-shaped container may be moved longitudinally along the bars (10,11) and attachment means (21,23) disposed on the outside of the bucket-shaped container and being adapted for lifting and transporting the bucket-shaped container for emptying.

2. Scraping device according to claim 1 wherein a supporting plate (40) is secured on an outside surface of said rear wall (4) and wherein said attachment means (21,23) is secured to said plate (40).

3. Scraping device according to claim 2 wherein said attachment means (21) includes a pair of spaced receiving pocket elements (21—21) disposed above the bucket-shaped container for receiving palette forks of a propelling machine.

4. Scraping device according to claim 2 wherein said attachment means (23) includes a pair of spaced angular elements (23—23) disposed above the pocket elements (21—21) for receiving shovel means of a propelling machine.

* * * * *